US011655119B2

(12) United States Patent
Mitsui

(10) Patent No.: US 11,655,119 B2
(45) Date of Patent: May 23, 2023

(54) SHEET BINDING APPARATUS, SHEET POST PROCESSING APPARATUS HAVING THE SHEET BINDING APPARATUS AND IMAGE FORMING SYSTEM HAVING THE SHEET BINDING APPARATUS

(71) Applicant: Yusuke Mitsui, Yamanashi-ken (JP)

(72) Inventor: Yusuke Mitsui, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 27 days.

(21) Appl. No.: 17/366,797

(22) Filed: Jul. 2, 2021

(65) Prior Publication Data

US 2022/0002110 A1 Jan. 6, 2022

(30) Foreign Application Priority Data

Jul. 6, 2020 (JP) ..... JP2020-116156

(51) Int. Cl.
*B65H 37/04* (2006.01)

(52) U.S. Cl.
CPC ..... *B65H 37/04* (2013.01); *B65H 2404/64* (2013.01); *B65H 2513/51* (2013.01)

(58) Field of Classification Search
CPC ..... B65H 2301/51616; B65H 2301/43828
See application file for complete search history.

(56) References Cited

U.S. PATENT DOCUMENTS

2014/0353900 A1* 12/2014 Abe ..... B42B 5/00 270/58.08
2018/0017927 A1* 1/2018 Nobe ..... G03G 15/6541
2019/0291497 A1* 9/2019 Matsumoto ..... G06F 3/121
2019/0292001 A1* 9/2019 Nobe ..... B42C 1/12

FOREIGN PATENT DOCUMENTS

JP 2014-058368 A 4/2014
JP 2015-020339 A 2/2015

* cited by examiner

*Primary Examiner* — Jennifer Bahls
(74) *Attorney, Agent, or Firm* — Manabu Kanesaka

(57) ABSTRACT

The present invention is to provide a sheet binding apparatus capable of performing stable pressure-bonding binding processing. A sheet binding apparatus includes a moving means configured to move at least one of the first binding portion and the second binding portion to bring the first binding portion and the second binding portion into pressure contact with each other, and a plurality of peeling members configured to apply peeling force in a direction opposite to a pressure-bonding direction to peel off a bound portion of the sheets stuck to the surface when the first binding portion and the second binding portion are separated by the moving means after pressure-bonding binding processing is performed. Here, the peeling force is applied by the plurality of peeling members at different timings.

8 Claims, 7 Drawing Sheets

SHEET BINDING APPARATUS, SHEET POST PROCESSING APPARATUS HAVING THE SHEET BINDING APPARATUS AND IMAGE FORMING SYSTEM HAVING THE SHEET BINDING APPARATUS

TECHNICAL FIELD

The present invention relates to a sheet binding apparatus for pressure bonding and binding sheets fed from an image forming apparatus or the like, a sheet post processing apparatus having the sheet binding apparatus, and an image forming system having the sheet binding apparatus.

BACKGROUND ART

Conventionally, a stapleless binding apparatus has been used in which a plurality of sheets are stacked and pressure bonded between a pair of concavo-convex pressure-bonding teeth, whereby sheets are pressure bonded to each other to bind a sheet bundle without using a metal staple. However, in such a stapleless binding apparatus, there is a problem that the sheet bundle sticks to the pressure-bonding teeth when the pressure-bonding teeth are to be separated.

Patent Document 1 discloses a sheet bundle binding processing apparatus in which a side aligning member for aligning a sheet bundle on a processing tray in a direction orthogonal to a discharging direction is used to feed out a sheet bundle subjected to binding processing from a side, thereby peeling off the sheet bundle from a pressing surface of a stapleless binding means.

Patent Document 2 discloses an apparatus in which a configuration for peeling off sheets stuck to pressure-bonding teeth having a concavo-convex shape is provided.

PRIOR ART DOCUMENT

Patent Document

[Patent Document 1] Japanese Patent Application Laid-Open No. 2015-020339

[Patent Document 2] Japanese Patent Application Laid-Open No. 2014-058368

DISCLOSURE OF INVENTION

Problems to be Solved by the Invention

In Patent Document 1 described above, since a sheet bundle is fed out in a certain linear direction, there is a fear that it is difficult to peel off the sheet bundle from the concavo-convex pressing surface of the pressure-bonding teeth of the stapleless binding means.

In Patent Document 2 described above, since a peeling means is provided only on either the inside or the outside of the binding teeth, there is a fear that sufficient peeling force cannot be exhibited depending on deflection of the sheets and the bound position (such as a corner part), and large force is required for peeling.

Accordingly, in view of the above problems in the prior art, the object of the present invention is to provide a sheet binding apparatus and an image forming system including the same, in which a sheet bundle subjected to pressure-bonding binding processing can be easily peeled off from pressure-bonding teeth.

Means for Solving the Problem

In order to achieve the above objects, the sheet binding apparatus of the present invention is configured to pressure bond and bind sheets by a first binding portion and a second binding portion each having surfaces to be engaged with each other, each of the surface being provided with a plurality of tops and bottoms, and includes a moving means configured to move one of the first binding portion and the second binding portion to bring the first binding portion and the second binding portion into pressure contact with each other, and a plurality of peeling members configured to apply peeling force in a direction opposite to a pressure-bonding direction to peel off a bound portion of the sheets stuck to the surface when the first binding portion and the second binding portion are separated by the moving means after pressure-bonding binding processing is performed. Here, the peeling force is applied by the plurality of peeling members at different timings.

The peeling mechanism applies peeling force to the sheets in a stepwise manner in a direction opposite to the direction in which the sheets are pressure bonded by the binding teeth, so that the sheets can be stably peeled off from the binding teeth.

Advantageous Effect of the Invention

According to the present invention, after pressure-bonding binding is performed, the sheets can be peeled off from the binding teeth with small force.

BRIEF DESCRIPTION OF DRAWINGS

FIG. 7A is a view of the paper guide member in a standby position and FIG. 7B is a view of the paper guide member in an operating position.

MODE FOR CARRYING OUT THE INVENTION

Figure 1:
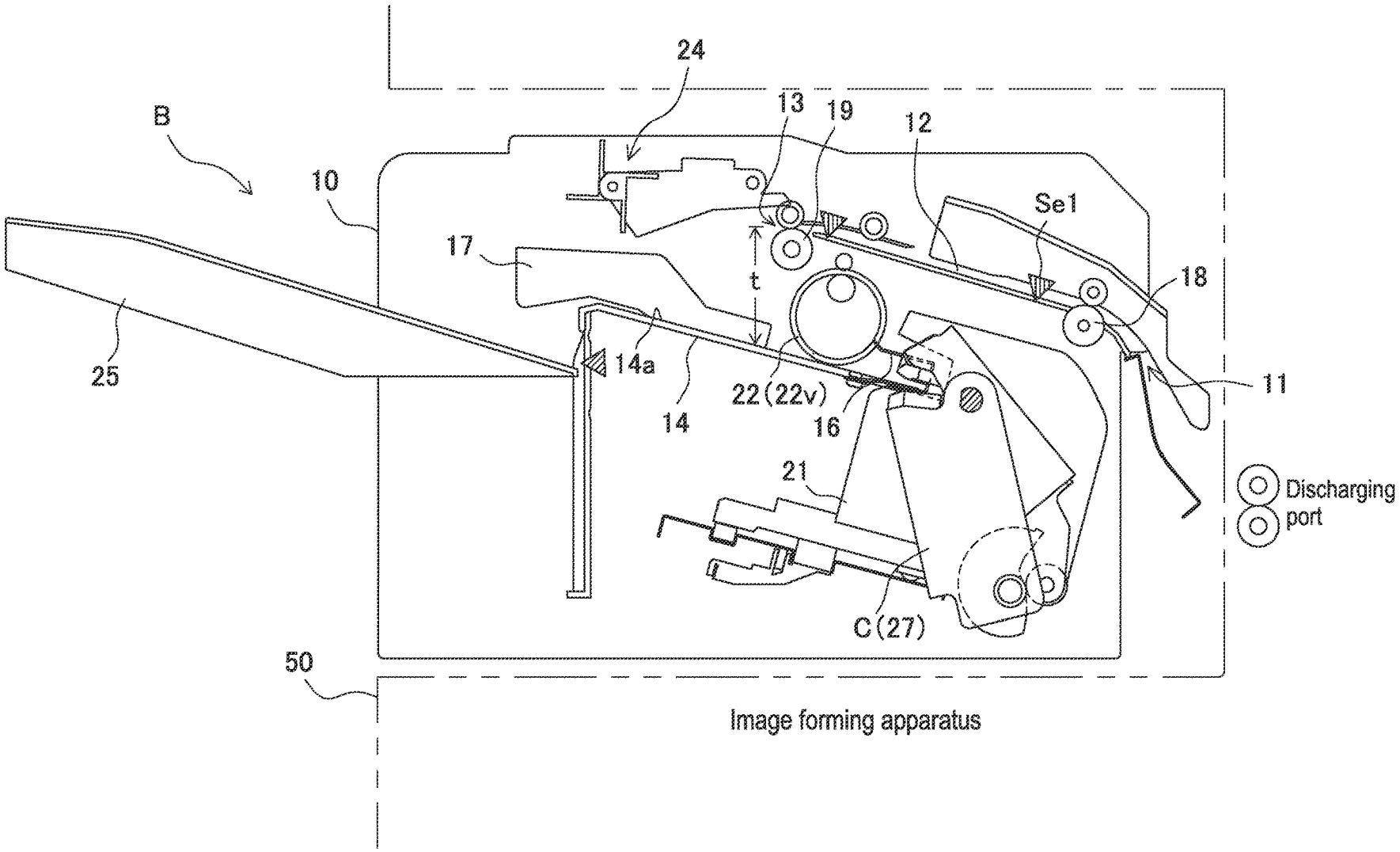
FIG. 1 is an explanatory view of a post processing apparatus which incorporates a sheet binding apparatus according to the present invention.

Hereinafter, the present invention will be described in detail based on embodiments shown in the drawings. FIG. 1 shows a post processing apparatus B which is arranged on the downstream side of an image forming apparatus 50 and aligns and performs binding processing on image-formed sheets. A binding processing unit C (a sheet processing apparatus, the same hereinafter) is incorporated in the post processing apparatus B.

[Post Processing Apparatus]

Next, the post processing apparatus B shown in FIG. 1 will be described. The illustrated post processing apparatus B incorporates the binding processing unit C (a pressure-bonding binding means 27, the same hereinafter) and is configured as a terminal device of an image forming system.

The post processing apparatus B in FIG. 1 includes an apparatus frame 10, a sheet conveyance path 12 arranged therein, a processing tray 14 (a sheet supporting means, the same hereinafter) arranged on the downstream side of a path discharging port 13 of the sheet conveyance path 12, and a stack tray 25 arranged on the downstream side thereof.

The processing tray 14 is provided with a sheet carry-in means 24 for carrying in a sheet S, and a position regulating means (a sheet end regulating member 16 and a side edge aligning member 17 described later) for positioning the carried-in sheet S to a predetermined post processing position P (binding position). The processing tray 14 is provided with the sheet processing apparatus (the binding processing unit C; the pressure-bonding binding means 27) which performs binding processing on the sheet bundle S. Although the configuration of the pressure-bonding binding means 27 will be described later, the pressure-bonding binding means 27 is provided on the rear side (the back side of the apparatus) of the processing tray 14, and is arranged at a position where a corner part of the sheets are bound.

The processing tray 14 is provided with a staple binding means 21 which performs binding processing on the sheets S as well as the pressure-bonding binding means 27, and the sheets S stacked on the processing tray 14 are subjected to pressure-bonding binding or staple binding by the means designated.

The apparatus frame 10 is provided with the sheet conveyance path 12 including a carry-in port 11 and a path discharging port 13 as shown in FIG. 1. In FIG. 1, the sheet S is received from the horizontal direction and conveyed in a substantially horizontal direction so as to be discharged from the path discharging port 13. A conveyance mechanism (such as a conveyance roller) for conveying the sheet S is incorporated in the sheet conveyance path 12.

The conveyance mechanism is configured of conveyance roller pairs having a predetermined interval in accordance with a path length, and a carry-in roller pair 18 is arranged in the vicinity of the carry-in port 11, and a discharging roller pair 19 is arranged in the vicinity of the path discharging port 13. The carry-in roller pair 18 and the discharging roller pair 19 are connected to the same driving motor (not shown) and convey the sheet S at the same circumferential speed. Further, a sheet sensor Se1 which detects at least one of the front end and the rear end of the sheet S is arranged at the sheet conveyance path 12.

The processing tray 14 is arranged at the downstream side of the path discharging port 13 of the sheet conveyance path 12 with a step t formed therebetween. The processing tray 14 includes a sheet placement surface 14*a* for supporting at least a part of the sheets S in order to stack the sheets S, fed from the path discharging port 13, upward in a bundle form. The processing tray 14 is configured to stack the sheets S fed from the path discharging port 13 in a bundle form, to perform binding processing after aligning the sheets S to a predetermined posture, and to discharge the processed sheet bundle to the stack tray 25 on the downstream side.

The sheet carry-in means 24 (a paddle rotating body) is arranged at the path discharging port 13, and conveys the sheet S to a predetermined position of the processing tray 14. Further, the processing tray 14 is provided with a raking conveyance means 22 for guiding the sheet rear end to the sheet end regulating member 16.

The raking conveyance means 22 is arranged on the upstream side of the sheet end regulating member 16, and in FIG. 1, the raking conveyance means 22 is configured of a ring-shaped belt member. This belt member 22*v* rotates in a direction in which the sheet S is conveyed toward the sheet end regulating member (a position regulating means) 16 while engaging with the uppermost sheet S on the sheet placement surface 14*a*.

The sheet end regulating member 16 for positioning the sheet S is arranged at a front end part (a rear end portion in the sheet discharging direction in FIG. 1) of the processing tray 14. Then, the sheet S carried in from the path discharging port 13 by the raking conveyance means 22 is abutted and regulated. The sheet end regulating member 16 aligns the sheets S stacked on the processing tray 14 to the predetermined processing position.

Further, the processing tray 14 is provided with a side edge aligning member 17 for positioning, in the width direction, the sheets S positioned by the sheet end regulating member 16 on a reference line. The illustrated side edge aligning member 17 aligns the sheets S in width fed from the path discharging port 13 and positioned by the sheet end regulating member 16 in the direction perpendicular to the sheet discharging direction. The side edge aligning member 17 is configured of a pair of right and left aligning plates, and positions the sheets S on the predetermined reference line (center reference or side reference).

The processing tray 14 is provided with the pressure-bonding binding means 27 and the staple binding means 21 which perform binding processing on the sheets S abutted and regulated by the sheet end regulating member 16 and positioned in the width direction by the side edge aligning member 17.

Since a sheet binding processing mechanism and the binding processing operation of the staple binding means 21 are already well known, description thereof will be omitted. The processing tray 14 is provided with the pressure-bonding binding means 27 which performs binding processing on the stacked sheet bundle as well as the staple binding means 21. The illustrated pressure-bonding binding means 27 shows a binding processing unit (the sheet processing apparatus C) which performs pressure-bonding binding processing on a plurality of sheets (bundle).

[Pressure-Bonding Binding Means]

The pressure-bonding binding means 27 (the sheet processing apparatus C, the same hereinafter) according to the present invention will be described with reference to FIGS. 2 and 3. The pressure-bonding binding means 27 presses and deforms a plurality of sheets stacked in a bundle form so that the sheets are engaged with each other, and binds them. For the above, the pressure-bonding binding means 27 is configured of a mechanism for sandwiching and pressure bonding a plurality of sheets by opposing binding teeth.

The pressure-bonding binding means 27 is configured of a pair of first binding teeth 27*b* and second binding teeth 27*c* for pressure bonding the sheet bundle S, a first frame 27*d* which supports the first binding teeth 27*b*, and a second frame 27*a* which supports the second binding teeth 27*c*.

Figure 5A:
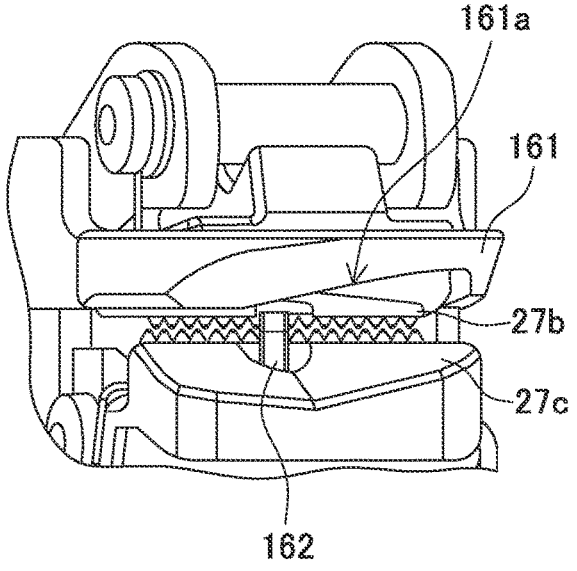
FIGS. 5A to 5D are explanatory views of peeling operation in the present apparatus.
Figure 5B:
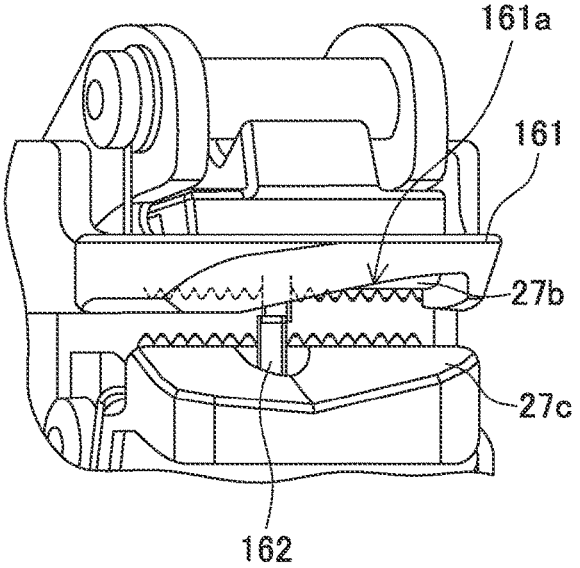
Figure 5D:
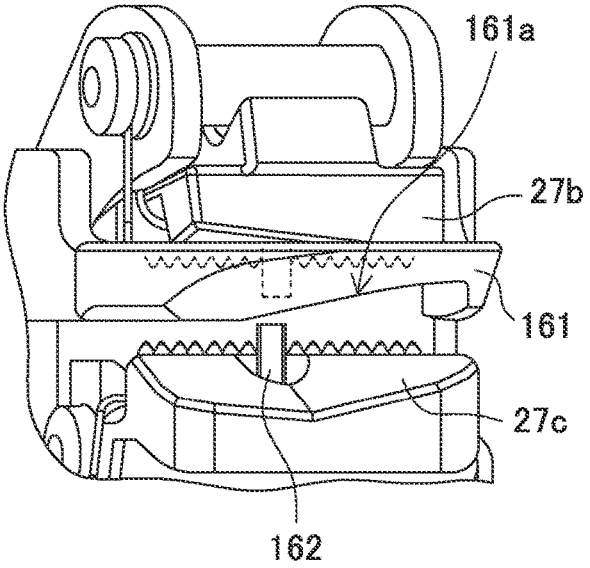
Figure 6A:
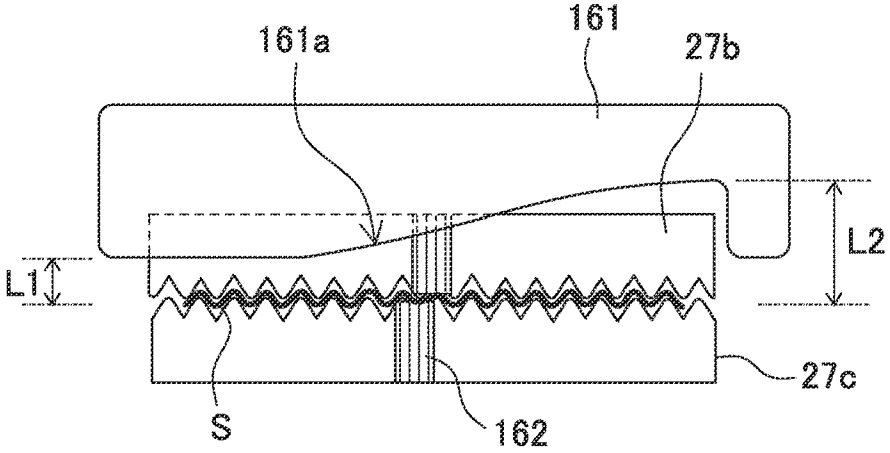
FIGS. 6A to 6D are schematic explanatory views of the peeling operation in the present apparatus.
Figure 6B:
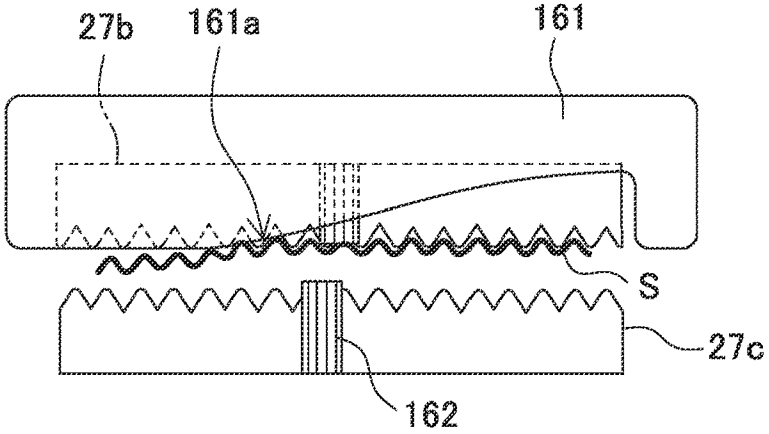

The first frame 27*d* and the second frame 27*a* are mounted to be positionally movable so that the first binding teeth 27*b* and the second binding teeth 27*c* are shifted between a standby posture (non-pressurizing posture; FIGS. 5D and 6D) in which they are separated and an operating posture (pressurizing posture; FIGS. 5A and 6A) in which they are pressure contacted. The illustrated second frame 27*a* is fixed to the apparatus frame 10 (unit frame), and the first frame 27*d* is rotatably connected to the second frame 27*a* by a swing rotation shaft 27*x*.

The first binding teeth 27*b* are attached to a distal end portion of the first frame 27*d* swingably connected by the swing rotation shaft 27*x*, and a second block member 42 is attached to a distal end part of the second frame 27*a*. Owing to the swing motion of the first frame 27*d* and the second frame 27*a*, the first binding teeth 27*b* and the second binding teeth 27*c* are shifted from the standby posture (non-pressurizing posture; FIGS. 5D and 6D) in which they are separated to the operating posture (pressurizing posture; FIGS. 5A and 6A) in which they are pressure contacted.

The first binding teeth 27*b* and the second binding teeth 27*c* are provided with a plurality of concavo-convex surfaces. In the first binding teeth 27*b* and the second binding teeth 27*c*, teeth having concavo-convex tooth patterns which are engaged with each other are arranged in rows with predetermined lengths at predetermined intervals (see FIGS. 5A to 6D).

The first frame 27*d* and the second frame 27*a* are provided with a driving means as a moving means for moving the first binding teeth 27*b* to an operating position in which the first binding teeth 27*b* and the second binding teeth 27*c* are in pressure contact with each other from a standby position in which they are separated from each other. The driving means is configured of a cam mechanism and a driving motor M9.

[Driving Means]

The first frame 27*d* and the second frame 27*a* described above are axially supported so as to be swingable about the rotation axis line of the swing rotation shaft 27*x*, and perform swing motion. The illustrated second frame 27*a* is fixed to the apparatus frame 10, and the first frame 27*d* is swingably attached by the swing rotation shaft 27*x* as described above to the second frame 27*a* fixed to the apparatus frame 10.

Therefore, the first frame 27*d* is supported swingably with respect to the second frame 27*a*. In the present embodiment, one of the first frame 27*d* and the second frame 27*a* is fixed to the apparatus frame 10 and the other is movably supported with respect to the apparatus frame 10, but both the first frame 27*d* and the second frame 27*a* may be movably supported with respect to the apparatus frame 10.

The driving means will be described. The first frame 27*d* is provided with the first binding teeth 27*b* at the distal end part thereof via the swing rotation shaft 27*x* and a cam follower 27*f* at a base end part thereof. The first binding teeth 27*b* arranged at the distal end part and the cam follower 27*f* are formed to have lever lengths with which leverage (a booster mechanism) acts via the swing rotation shaft 27*x*.

Further, a cam member 27*e* is arranged at the base end part of the second frame 27*a*. The cam member 27*e* is axially supported by the second frame 27*a* in a rotatable manner, and the cam member 27*e* and the cam follower 27*f* are arranged in a positional relationship in which they are engaged with each other. Further, the rotation of the driving motor M9 is transmitted to the cam member 27*e* via a transmission means, and the cam member 27*e* is connected so as to be rotated forwardly and reversely by forward and reverse rotation of the driving motor M9.

Figure 2:
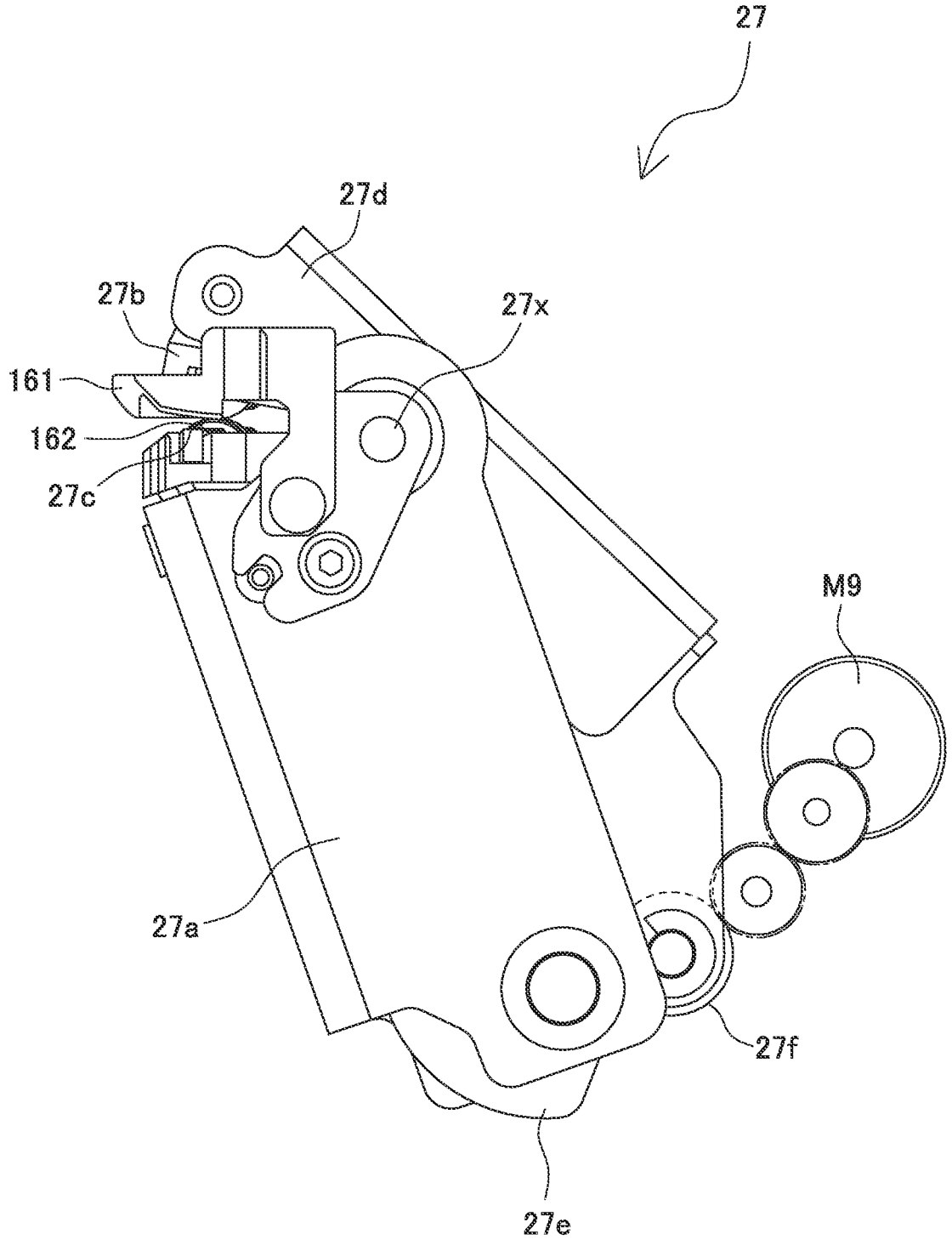
FIG. 2 is a detailed explanatory view of a pressure-bonding binding means.

The driving motor M9 shown in FIG. 2 is mounted on the apparatus frame 10 (e.g., the frame of the post processing apparatus), and transmits rotation to the cam member 27*e*.

Figure 3:
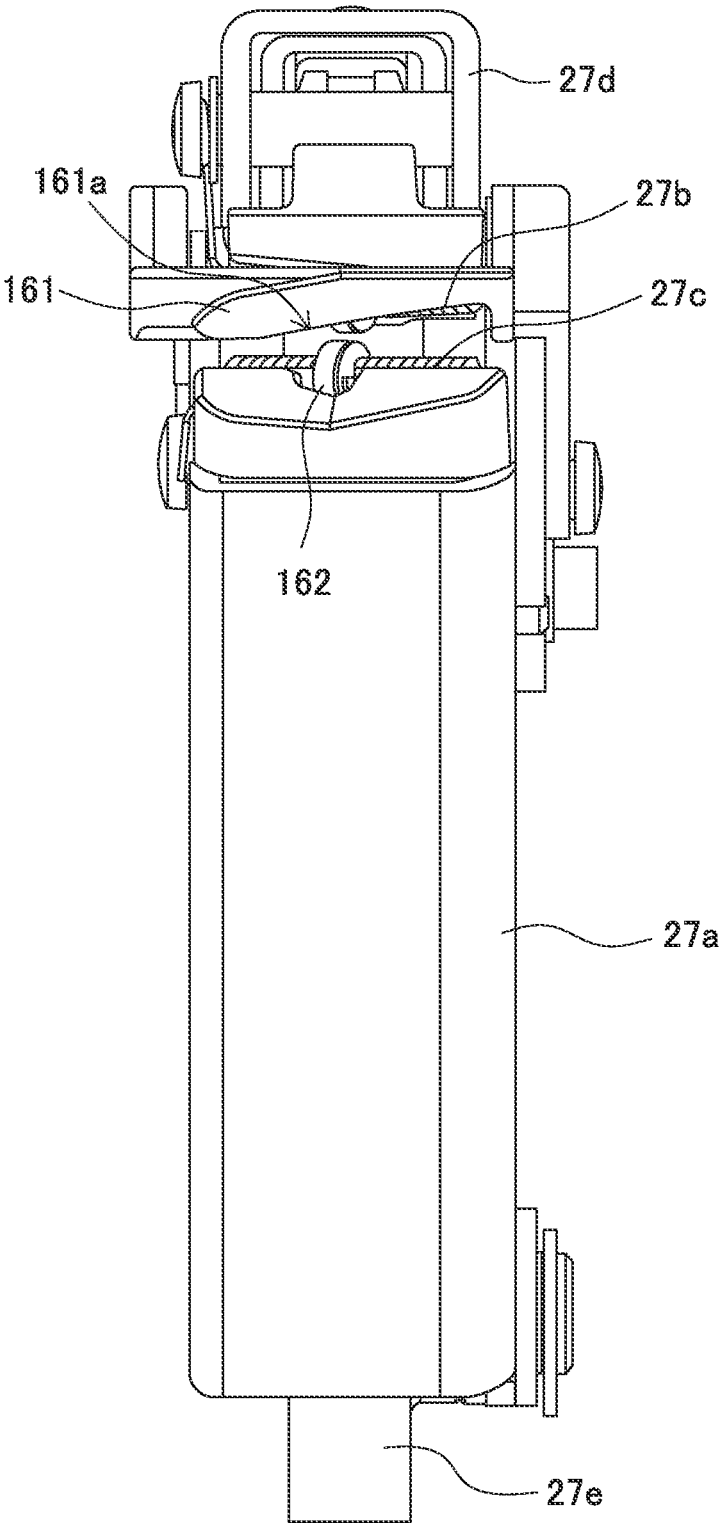
FIG. 3 is a side view of the pressure-bonding binding means.

As shown in FIG. 3, the second frame 27*a* is formed of a sheet metal having a U-shaped cross section, and the first frame 27*d* is swingably supported by the swing rotation shaft 27*x* between opposing side walls of the second frame 27*a*.

By the way, when the pressure-bonding binding processing as described above is performed, sheets may stick to the binding teeth after the binding processing, which may cause conveyance failure or sheet damage. Further, since the pressure-bonding binding processing generates large pressing force, it is also necessary to enhance safety. The pressure-bonding binding means 27 of the present embodiment includes a plurality of configurations for preventing the sheets and the binding teeth from being fixed to each other, and also serves as a mechanism for ensuring safety. These will be described in detail.

As shown in FIGS. 2 and 3, the pressure-bonding binding means 27 is provided with a movable binding teeth cover member 161. The movable binding teeth cover member 161 is fixed to the second frame 27*a*, and is arranged so as to surround the periphery of the first binding teeth 27*b* which moves to a position where it is engaged with the second binding teeth 27*c* also fixed to the second frame 27*a*. Even when the first binding teeth 27*b* are in the standby position farthest from the second binding teeth 27*c*, the movable binding teeth cover member 161 narrows and regulates the opening of the pressure-bonding binding means 27 to a certain height so as to prevent foreign matter from entering between the first binding teeth 27*b* and the second binding teeth 27*c*, thereby enhancing safety of the apparatus.

Figure 4:
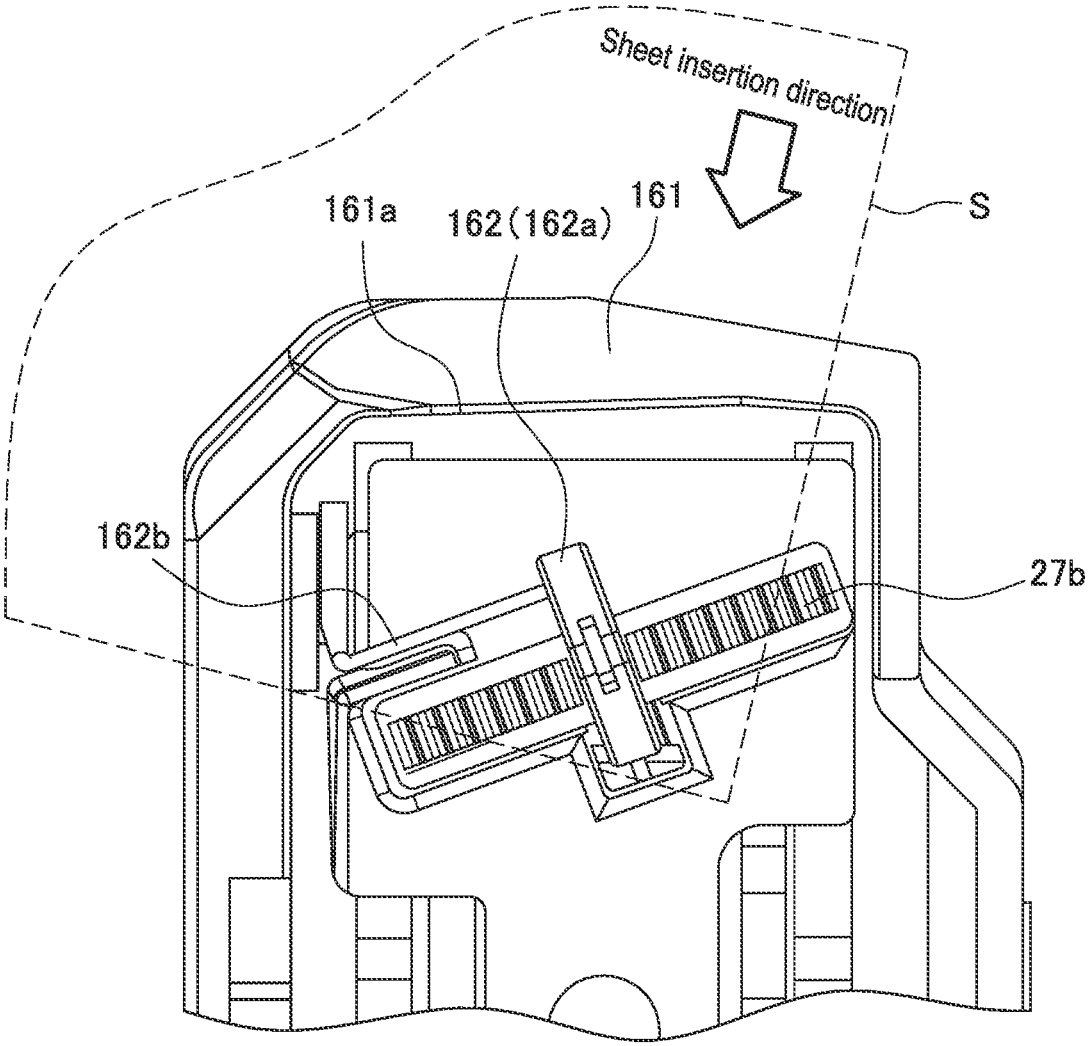
FIG. 4 is a view of movable binding teeth and a peeling member of the pressure-bonding binding means viewed from below, and shows a sheet insertion direction to the pressure-bonding binding means and a position of the sheets at the time of binding.

The movable binding teeth cover member 161 further prevents sticking between the sheets and the first binding teeth 27*b*. First, the first binding teeth 27*b* and the second binding teeth 27*c* are provided with a peeling spring member 162 in order to prevent the bound sheets from sticking to the pressure-bonding teeth. The peeling spring member 162 is arranged inside the pressure-bonding range of the first binding teeth 27*b* and the second binding teeth 27*c* as shown in FIGS. 3 and 4, and is configured of a line spring 162*b* which is fixed to the first frame 27*d* and the second frame 27*a* and a cap portion 162*a* which covers the line spring 162*b*. Owing to the spring property, the cap portion 162*a* is kept in a state of protruding from the binding teeth in the teeth height direction. As a result, when the first binding teeth 27*b* and the second binding teeth 27*c* are engaged with each other, the line spring 162*b* is depressed and the binding operation is not interfered, and when the first binding teeth 27*b* and the second binding teeth 27*c* are separated from each other, force to separate the binding teeth and the sheets can be applied simultaneously with the start of separation.

However, since the peeling spring member 162 always exerts force opposite to the pressure-bonding direction, if a strong line spring is used, not only the binding operation is interfered but also there is a fear that sheets are damaged in some cases. Therefore, the strength of the spring has to be limited. Therefore, it is difficult to ensure reliable peeling operation only by the peeling spring member 162. Accordingly, in the present embodiment, reliable peeling operation can be performed in cooperation with the movable binding teeth cover member 161.

The configuration of the movable binding teeth cover member 161 will be described in detail. The movable binding teeth cover member 161 is fixed to the first frame 27*d* as described above, and as shown in FIG. 4, is arranged at a position surrounding both ends of the movable binding teeth of the present embodiment, that is, the first binding teeth 27*b* in the longitudinal direction and the sheet receiving direction (sheet insertion direction). FIGS. 5A and 6A show a state in which the binding teeth are at the pressure-bonding position, and here, the movable binding teeth cover member 161 is at a position separated from the sheets. FIGS. 5B and 6B show a state in which the first binding teeth 27*b* starts to separate (a state in which the sheets are stuck to the first binding teeth 27*b*), and at this time, peeling force of the peeling spring member 162 is first applied to the sheets, and then the movable binding teeth cover member 161 comes into contact with the sheets to further apply peeling force.

Figure 5C:
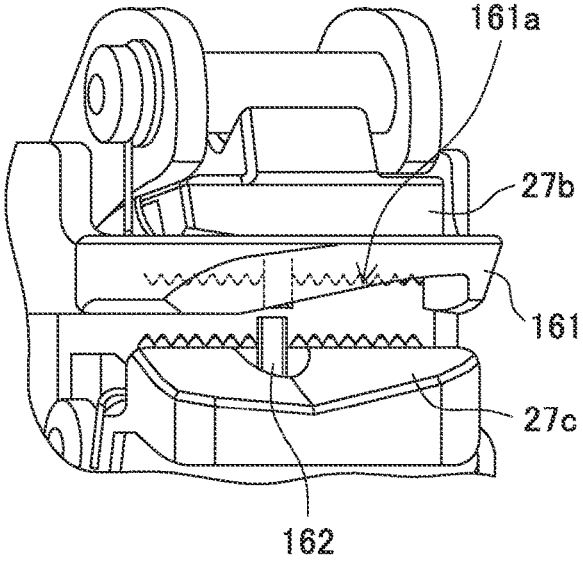
Figure 6C:
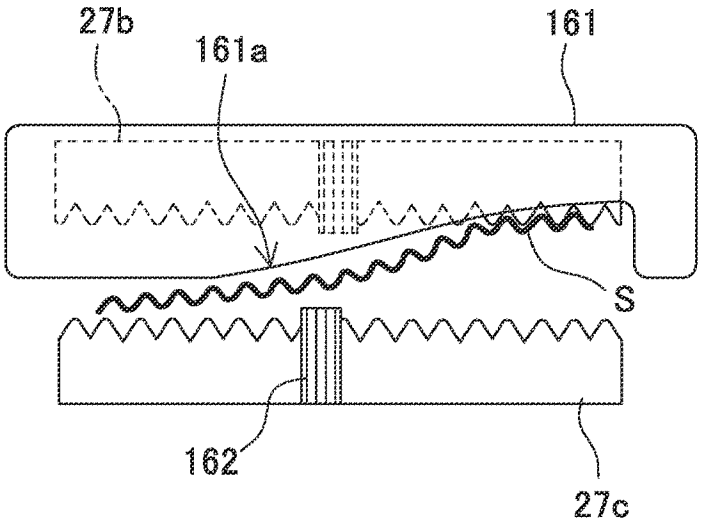
Figure 6D:
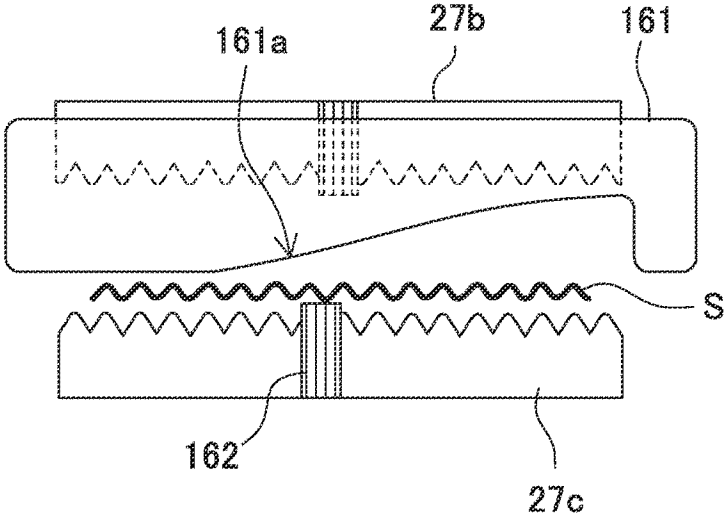

In FIGS. 5C and 6C, the first binding teeth 27*b* are retracted to a position hidden inside the movable binding teeth cover member 161. At this time, the sheets come into contact with the movable binding teeth cover member 161, and can be peeled off even if the first binding teeth 27*b* and the sheets S are in a bitten state. Thereafter, as shown in FIGS. 5D and 6D, a completely retracted state is obtained. As shown in FIGS. 3 to 6, the movable binding teeth cover member 161 is provided with an inclined guide surface 161*a* which is wider on the entrance side than on the back side in the direction in which the sheets enter the opening of the binding teeth. The inclination of the inclined guide surface 161*a* is set such that the distance (L2 in FIG. 6A) between the movable binding teeth cover member 161 and the second binding teeth 27*c* on the entrance side is larger than the distance (L1 in FIG. 6A) between the movable binding teeth cover member 161 and the second binding teeth 27*c* on the back side at the time of sheet insertion (i.e., the relation of L1<L2 in FIGS. 6A to 6D is satisfied). This facilitates guiding and smooth positioning at the time of conveyance in the sheet insertion direction to the binding position, and also provides the peeling effect described later.

The inclined guide surface 161*a* arranged on the movable binding teeth cover member 161 will be described with reference to FIGS. 6A to 6D. FIG. 6A shows a state in which the sheets S are bound by the first binding teeth 27*b* and the second binding teeth 27*c*, and FIG. 6B shows a state in which the sheets S stuck to the first binding teeth 27*b* start to come into contact with a portion, located at the backmost side (in the sheet insertion direction), of the guide surface 161*a* arranged on the movable binding teeth cover member 161, and are gradually peeled off along the inclination of the guide surface 161*a*. At this time, since the area of the part where the sheets stick to the binding teeth also decreases, the peeling effect by the peeling spring member 162 is also enhanced. Then, peeling gradually proceeds into the state of FIG. 6C and then the state of FIG. 6D.

Since the movable binding teeth cover member 161 performs peeling from one end in the longitudinal direction toward the other end after peeling force of the peeling spring member 162 is applied to the sheets instead of peeling off the stuck part between the sheets and the binding teeth at once, damage such as tearing due to sudden application of force to the sheets and binding failure such as bundle separation can be prevented, and binding processing with high quality can be performed. In addition, since the change in the application of force becomes gradual and the load on the apparatus is small, it is unnecessary to provide excessive rigidity, and it is possible to reduce the cost and size of the apparatus.

Further, since the movable binding teeth cover member 161 is arranged so as to reach the outside of both end parts of the first binding teeth 27*b* in the longitudinal direction, when the corner part of the sheets are bound, the sheets are peeled off mainly using the inclined part of the guide surface 161*a* as described above, and when the sheets are bound along the side (so-called two-position binding or the like), the sheets are peeled off with both end parts of the binding teeth in the longitudinal direction also simultaneously acting. Thus, even if the binding teeth and the sheets are strongly fixed (stuck) to each other, reliable peeling operation can be performed. Further, in addition to the peeling mechanism described above, it is also possible to perform rotating peeling operation as disclosed in Japanese Patent Application Laid-Open No. 2016-199396 and the like.

[Paper Guide Mechanism]

The processing tray 14 is provided with a paper guide mechanism 80, for guiding sheets, between the first binding teeth 27*b* and the second binding teeth 27*c* of the pressure-bonding binding means 27 when the sheet bundle is moved to the binding position.

Figure 7A:
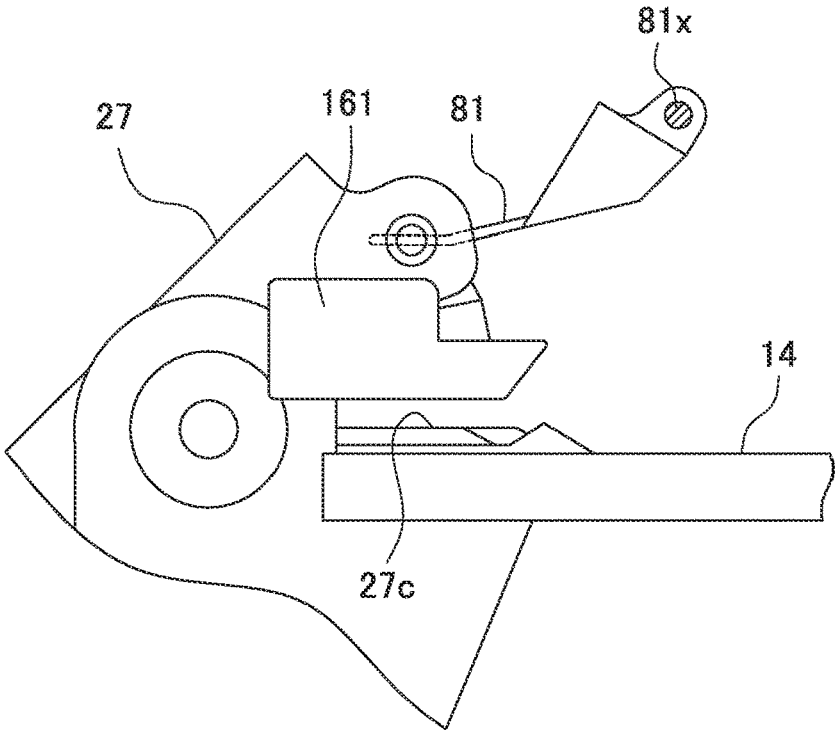
FIGS. 7A and 7B are explanatory views of operation of a paper guide member, where
Figure 7B:
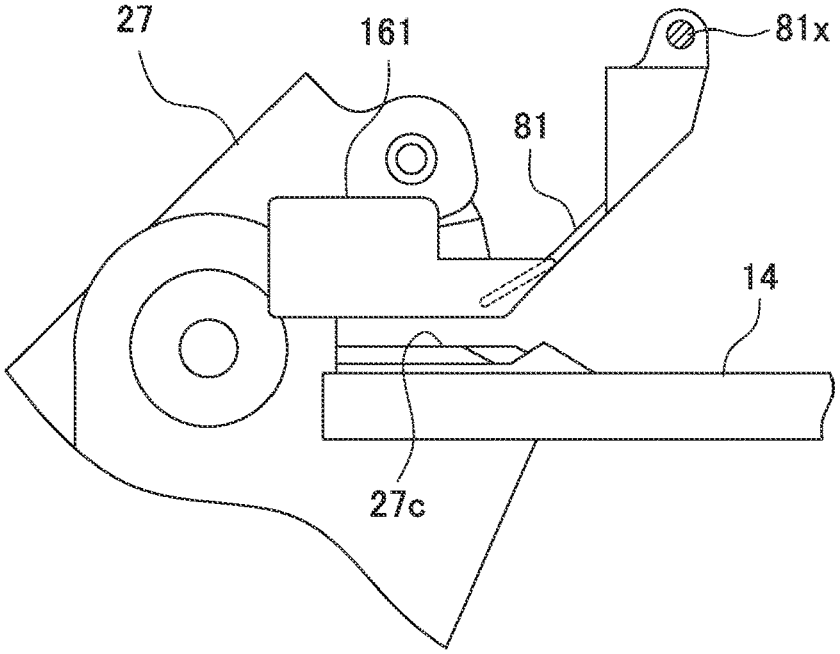

FIGS. 7A and 7B shows the paper guide mechanism 80. The apparatus frame 10 is provided with a paper guide member 81 which guides the sheets to the binding position arranged above the processing tray 14 and on the upstream side of the pressure-bonding binding means 27 in the sheet insertion direction described above. The paper guide member 81 has a paper guide surface 81*a* for guiding the sheet bundle between a pair of vertically opposed pressing surfaces 27*b* and 27*c* of the binding processing unit 27.

When the sheets are conveyed onto the processing tray 14, the paper guide member 81 is retracted above the processing tray 14 so as not to interfere the conveyance, and when moving the sheets to the binding position after placement of the sheets, the guide surface 81*a* is swingable about a shaft 81*x* provided at the apparatus frame 10 so as to guide the upper surface of the sheets. Thus, the paper guide member 81 is arranged to be capable of changing the height position.

The paper guide member 81 can be moved by a driving means (not shown) between an operating position (as in the state of FIG. 7B) where the paper guide member 81 is engaged with the upper surface of the sheets on the processing tray 14 and a standby position (as in the state of FIG. 7A) where the paper guide member 81 is retracted above the processing tray 14.

As shown in FIG. 7B, when the paper guide member 81 is positioned at the operating position, the paper guide member 81 is inclined at substantially the same angle (about 45 degrees) as a sheet receiving angle of the movable binding teeth cover member 161 described above, and is in an overlapping positional relationship, so that the area for guiding the sheets is widened. By causing the paper guide member 81 and the movable binding teeth cover member 161 to cooperate with each other in this manner, it is possible to reliably insert the sheets to the binding position.

In the above, the present invention has been described with reference to the preferred embodiment. However, the present invention is not limited to the above-described embodiment, and it is obvious that various changes or modifications can be made within the technical scope of the present invention. For example, the problem of sticking between the pressure bonded and bound sheets and the pressure-bonding member is not limited to that with the binding teeth having the concavo-convex shape described in the present embodiment, and the same problem may occur in the case of binding by applying a binding substance such as an adhesive or adhesive toner to the surface of the sheets, or in the case of binding by applying moisture to the sheets. Even in such a case, the effects of the present invention can be obtained.

This application claims the benefit of Japanese Patent Application No. 2020-116156 which is incorporated herein by reference.

The invention claimed is:

1. A sheet binding apparatus configured to bind sheets, comprising:

a first binding portion and a second binding portion each having a surface to be engaged with each other with sheets therebetween, each of the surfaces being provided with a plurality of tops and bottoms;

a moving means configured to move the first binding portion toward the second binding portion fixed and to bring the first binding portion and the second binding portion into pressure contact with the sheets between the first binding portion and the second binding portion to bind the sheets with pressure and to move the first binding portion away from the second binding portion after binding the sheets with pressure; and a peeling member configured to apply peeling force in a direction opposite to a pressure direction for the pressure contact with the sheets to peel off a bound portion of the sheets from the plurality of tops and bottoms of the surfaces when the first binding portion is moved away from the second binding portion by the moving means after binding the sheets with processing, wherein the peeling member includes an inclined surface, which when the first binding portion is moved away from the second binding portion, abuts against the sheets contacting with the plurality of tops and bottoms of the surface of the first binding portion, and a distance between one end of the inclined surface in a longitudinal direction of the first binding portion and the second binding portion in a moving direction that the moving means moves the first binding portion toward the second binding portion is different from a distance between another end of the inclined surface in the longitudinal direction and the second binding portion in the moving direction.

2. The sheet binding apparatus according to claim 1, wherein the peeling member includes a first peeling member arranged inside the plurality of tops and bottoms of the surfaces of the first binding portion, and a second peeling member arranged outside the plurality of tops and bottoms of the surfaces of the first binding portion, and wherein timings to apply the peeling force to the sheets are different by the first peeling member and the second peeling member.

3. A sheet post processing apparatus comprising:

the sheet binding apparatus according to claim 2.

4. An image forming system comprising:

the sheet post processing apparatus according to claim 3.

5. A sheet binding apparatus configured to bind sheets with pressure, comprising:

an apparatus frame;

a second binding portion fixed to the apparatus frame;

a first binding portion configured to be moved toward the second binding portion to press and bind sheets sandwiched between the first binding portion and the second binding portion;

a moving means configured to move the first binding portion between a standby position separated from the second binding portion and a pressure-contact position where the second binding portion and the first binding portion are pressure contacted with the sheets;

a first peeling member arranged inside a binding range of the first binding portion and configured to peel off the sheets from the first binding portion; and a second peeling member fixed inside the apparatus frame to be located between the standby position and the pressure-contact position of the first binding portion to surround a periphery of the first binding portion.

6. The sheet binding apparatus according to claim 5, wherein the second peeling member includes an inclined surface to be in contact with the sheets, and in a longitudinal direction of the binding portion, a distance on one end of the inclined surface between the inclined surface and the second binding portion is different from a distance on the other end thereof.

7. A sheet post processing apparatus comprising:

the sheet binding apparatus according to claim 5.

8. An image forming system comprising:

the sheet post processing apparatus according to claim 7.

* * * * *